US011187213B2

(12) United States Patent
Bhatt et al.

(10) Patent No.: US 11,187,213 B2
(45) Date of Patent: Nov. 30, 2021

(54) THRUSTER DEVICE

(71) Applicants: Ankur Bhatt, San Jose, CA (US); Frank M. Becker, Huerth-Berrenrath (DE)

(72) Inventors: Ankur Bhatt, San Jose, CA (US); Frank M. Becker, Huerth-Berrenrath (DE)

( * ) Notice: Subject to any disclaimer, the term of this patent is extended or adjusted under 35 U.S.C. 154(b) by 229 days.

(21) Appl. No.: 16/518,997

(22) Filed: Jul. 23, 2019

(65) Prior Publication Data

US 2020/0332780 A1 Oct. 22, 2020

Related U.S. Application Data

(60) Provisional application No. 62/703,438, filed on Jul. 26, 2018.

(51) Int. Cl.
*F03H 1/00* (2006.01)
*H01J 29/48* (2006.01)

(52) U.S. Cl.
CPC ..... *F03H 1/0087* (2013.01); *H01J 29/481* (2013.01)

(58) Field of Classification Search
CPC ..... H01J 35/24; F03H 1/0043; F03H 1/005; F03H 1/0056; F03H 1/0087
See application file for complete search history.

(56) References Cited

U.S. PATENT DOCUMENTS 3,877,348 A 4/1975 Sandlin
4,572,011 A 2/1986 Mauchlen
6,029,438 A 2/2000 Hosick
6,373,023 B1 4/2002 Hoskins et al.
6,435,120 B2 8/2002 Duncan
7,530,219 B1 5/2009 Burton et al.
9,623,942 B2 4/2017 Schiaffino et al.
2007/0007393 A1 1/2007 Pinto
(Continued)

OTHER PUBLICATIONS

Quantized inertia—Wikipedia (Year: 2020).*
(Continued)

*Primary Examiner* — Arun Goyal
*Assistant Examiner* — William L Breazeal
(74) *Attorney, Agent, or Firm* — Kanika Radhakrishnan; Evergreen Valley Law Group

(57) ABSTRACT

The present disclosure provides a thruster device. The device includes a force-generating element mounted to a housing. The element is configured to generate a thrust force for propelling the housing. The element including a first electrode connected to a first input terminal of a power source. A second electrode is spaced apart by a predetermined distance from the first electrode and connected to a second input terminal of the power source. The second electrode includes a second longitudinal axis oriented parallelly to a first longitudinal axis. A dielectric medium is disposed between the electrodes. Upon receiving field emission condition, charged particles available at the first electrode accelerate towards the second electrode for generating a thrust force along a direction of movement of the charged particles. The thrust force is generated when the predetermined distance between the electrodes is shorter than a Rindler horizon defined by the charged particles during acceleration.

20 Claims, 9 Drawing Sheets

(56) References Cited

U.S. PATENT DOCUMENTS

| | | | |
|---|---|---|---|
| 2017/0297747 | A1 | 10/2017 | Peterka, III et al. |
| 2018/0051679 | A1 | 2/2018 | Khachan et al. |

OTHER PUBLICATIONS

Talley, Robert L., "Twenty first century propulsion concept." No. F06-9-1. Veritay Technology Inc East Amherst NY, 1991., entire document [online] URL< https://apps.dtic.mil/dtic/tr/fulltexVu2/a237853.pdf.

Becker et al., "Electrostatic accelerated electrons within symmetric capacitors during field emission condition events exert bidirectional propellant-less thrust." arXiv preprint arXiv:1810.04368 (Published: Oct. 10, 2018), entire document [online] URL<https:/Jui.adsabs.harvard.edu/abs/2018arXiv1810043688/abstract.

* cited by examiner

THRUSTER DEVICE

TECHNICAL FIELD

The present disclosure generally relates to thruster or propulsion devices and, more particularly, to thruster devices that are configured to generate thrust by altering inertial mass of accelerating charged particles.

BACKGROUND

Various applications make use of a thrust force for moving an object forward. For example, vehicles such as but not limited to aircraft, rockets and the like, are propelled forward using the thrust force. The thrust force is typically generated via an engine mounted within such vehicles. The engine includes a combustion chamber, which utilizes propellants as fuel for combustion. The propellants are typically forced through a nozzle for combustion within the combustion chamber, leading to an exothermic chemical reaction. The chemical reaction generates hot exhausts which are discharged at high speeds from the nozzle, generating the thrust force for propelling the object.

The usage of propellants, such as rocket fuel is associated with several adverse effects. For example, in the case of rockets, the rocket fuel used for propulsion is a non-renewable source of energy and burning of such a large amount of fuel may lead to depletion of fuel resources. Further, such propellants upon combustion discharge harmful gases, which may severely affect the atmosphere. Moreover, the propellants are typically expensive to procure and requires careful handling. The use of chemical propellants for space travel also affords a limited travel range and accordingly, the propellants have to be carried onboard or may have to be supplied during travel, which is practically cumbersome.

To preclude the use of propellants, many attempts have been made to make use of electrostatic or electromagnetic forces to generate thrust forces for propelling the object. For example, ion thrusters and electromagnetic thrusters which work on the principle of accelerating ions using electric voltage gradients have been introduced. However, such thrusters produce low thrust force, thereby limiting the applications to small spacecraft or space vehicles.

Accordingly, there is a need for techniques which can overcome one or more limitations stated above in addition to providing other technical advantages.

SUMMARY

Various embodiments of the present disclosure provide a thruster device. The device includes a force-generating element mounted to a housing. The force-generating element is configured to generate a thrust force for propelling the housing. The force-generating element including a first electrode connected to a first input terminal of a power source and having a first longitudinal axis. A second electrode is spaced apart by a predetermined distance from the first electrode and connected to a second input terminal of the power source. The second electrode includes a second longitudinal axis oriented parallelly to the first longitudinal axis. A dielectric medium (including vacuum) is disposed between the first electrode and the second electrode. Upon receiving a breakdown voltage or a field emission condition from the power source, charged particles available at the first electrode accelerate towards the second electrode for generating a thrust force along a direction of movement of the charged particles for propelling the housing. The usable thrust force is generated when the predetermined distance between the first electrode and the second electrode is significantly shorter than a Rindler horizon distance (in line with the propagation direction) defined by the charged particles during acceleration.

In an embodiment, the present disclosure also provides the thruster device. The device including a plurality of force-generating elements mounted to a housing. The plurality of force-generating elements are configured to generate a thrust force for propelling the housing. Each of the plurality of force-generating elements includes the first electrode connected to the first input terminal of the power source and including the first longitudinal axis. The second electrode (most simply, a plate to provide casual shielding to the charge to enable a confinement condition) is spaced apart by the predetermined distance from the first electrode and connected to the second input terminal of the power source. The second electrode includes the second longitudinal axis oriented parallelly to the first longitudinal axis. A dielectric medium (including vacuum) is disposed between the cathode electrode and the anode electrode. Upon receiving a breakdown voltage or achieving field emission condition from the power source, charged particles available at the first electrode accelerate towards the second electrode for generating a thrust force along a direction of movement of the charged particles for propelling the housing. The thrust force is generated when the predetermined distance between the first electrode and the second electrode is shorter than a Rindler horizon defined by the charged particles during acceleration.

BRIEF DESCRIPTION OF THE FIGURES

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device or a tool and instrumentalities disclosed herein. Moreover, those in the art will understand that the drawings are not to scale. Wherever possible, like elements have been indicated by identical numbers.

Figure 1A:
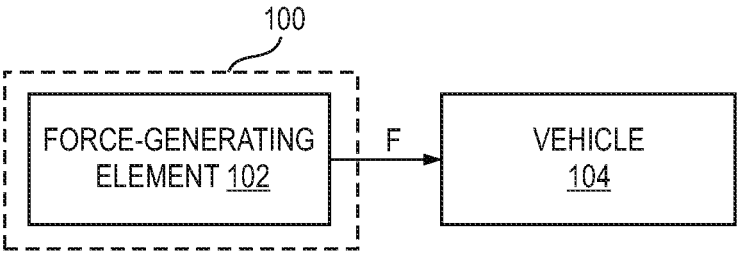
FIG. 1A illustrates a simplified block diagram representation of a thruster device, in accordance with an example embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearance of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Overview

Various embodiments of the present disclosure disclose a thruster device. The thruster device is configured to alter the inertial mass of accelerated charged particles for generating the thrust force required to propel an object. This configuration mitigates the need for propellants and therefore ensuring unlimited range for operation of the thruster device. Also, as the use of propellants are mitigated, the bulky and cumbersome components required for combustion of the propellants are eliminated, rendering a cost-effective and light structure of the object to be propelled. Moreover, the thruster device is configured to reach very high speeds by continuous acceleration as long as electric energy is present (close to the speed of light). As such, the thruster device may be used for space mining of asteroids, asteroid deflection, satellite maneuvering, maneuvering and propulsion of spacecrafts, and deep space traveling.

The thruster device includes a force-generating element mounted to a housing. The housing may be the object to be propelled or may be connected to the object to be propelled. The force-generating element is configured to generate the thrust force for propelling the housing. The force-generating element includes a first electrode connected to a first input terminal of a power source and includes a first longitudinal axis. A second electrode is spaced apart from the first electrode by a predetermined distance and is connected to a second input terminal of the power source. The second electrode includes a second longitudinal axis and is oriented parallelly to the first longitudinal axis. A dielectric medium (including vacuum) is disposed between the first electrode and the second electrode. The dielectric medium is configured to provide the acceleration and confinement conditions and resistance will influence the charge propagation and charge level. This configuration of the first electrode and the second electrode conforms to a capacitive system, which two parallel electrodes or plates connected to the power source.

Upon receiving a breakdown voltage or field emission condition which may include application of heat or liquids on the metal surface and/or utilization of the photoelectric effect for influencing charge liberation from the power source, charged particles made available at the first electrode accelerate towards the second electrode. Due to the acceleration, information pertaining to the charged particles never reach the accelerating charged particles. Here, an information symmetry breaking condition which modifies the natural status of inertia is established which could be interpreted as altering energy and momentum states associated to vacuum fluctuations surrounding the accelerated particle. Thus, from the charged particles point of view of space-time ends, a 'Rindler horizon' is formed behind the accelerating charged particles. Simultaneously, the accelerated charged particles are subjected to an alteration of the vacuum fluctuations similar to blackbody kind of radiations (i.e. Unruh radiations), which may be called as quantum vacuum oscillations (QVO). This tries to oppose the normal inertial conditions of the charged particles acceleration. Thus, by attenuation of the QVO condition (such as modifying the allowed frequency spectrum within the confinements), the inertial mass of the charged particles is altered. For compensating the inertial mass of the charged particles, the apparatus generates a force along the direction of the second electrode, as per the law of conservation of momentum and thereby generating the thrust force. For attenuating the QVO condition, the predetermined distance is configured to be shorter than the Rindler horizon defined behind the charged particles. In one configuration, the predetermined distance between the first and the second electrodes may be adjusted via a positioning mechanism. The positioned mechanism may be coupled to at least one of the first electrode and the second electrode for adjusting the predetermined distance. In another configuration, the positioning mechanism may be a stepper-motor mechanism, which is suitably coupled to the second electrode for adjusting the predetermined distance.

Various embodiments of a thruster device are explained in a detailed manner, herein with reference to FIGS. 1A-1B to FIGS. 13A-13B.

Figure 1B:
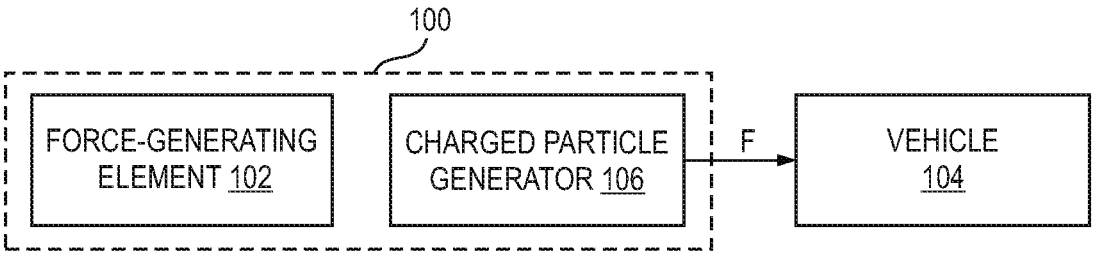
FIG. 1B illustrates a simplified block diagram representation of the thruster device, in accordance with another example embodiment of the present disclosure.
Figure 3:
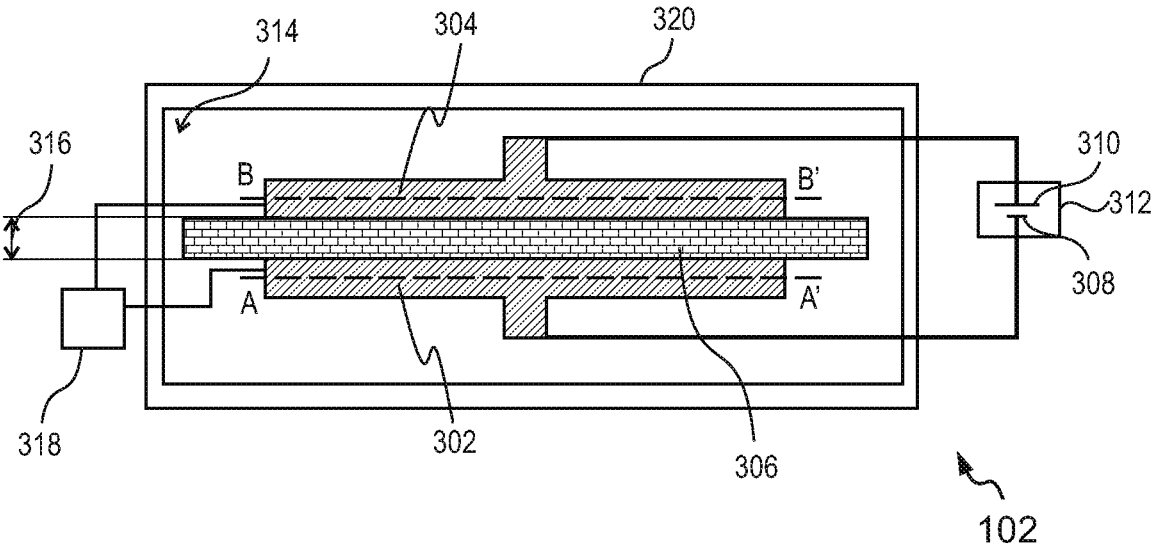
FIG. 3 illustrates a representation of a force-generating element of the thruster device, in accordance with an example embodiment of the present disclosure.
Figure 4A:
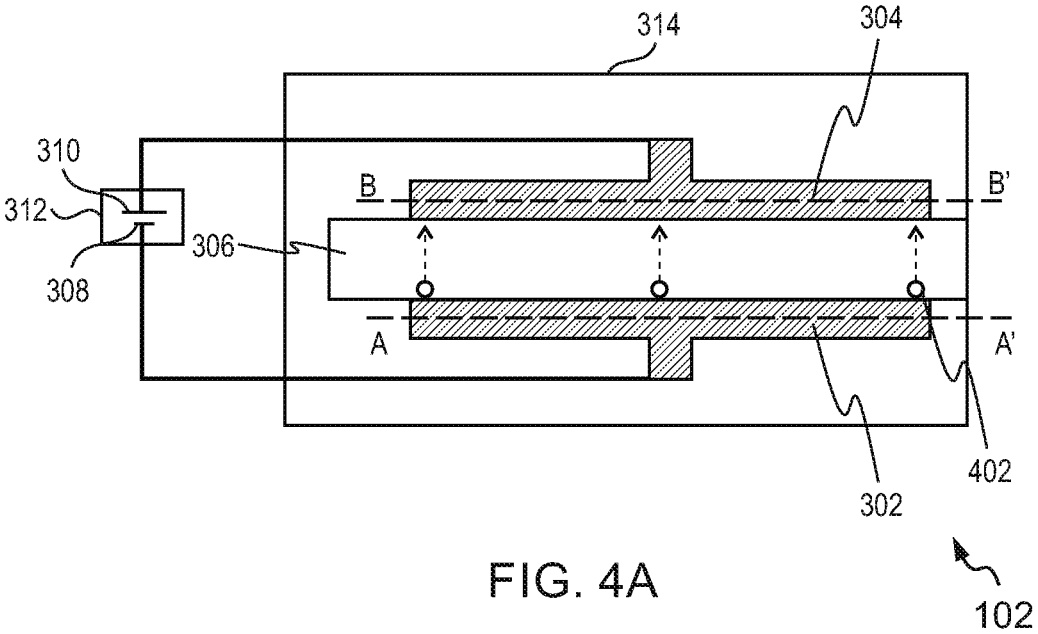
FIG. 4A illustrates a representation of acceleration of charged particles generated by a first electrode of the force-generating element under the influence of an electric field, in accordance with an example embodiment of the present disclosure.

FIGS. 1A and 1B illustrate simplified block diagram representations of a thruster device 100, in accordance with some example embodiments of the present disclosure. The thruster device 100 is depicted to include a force-generating element 102 mounted to a housing 320 (for e.g. as shown in FIG. 3) of an object, such as a vehicle 104. The force-generating element 102 may be configured to generate a thrust force required for propelling the vehicle 104. The force-generating element 102 may be configured to generate the thrust force via acceleration of charged particles 402 (for e.g. as shown in FIG. 4A), which is explained later in the present description. The force-generating element 102 may also be in operable communication with a charged particle generator 106 (for e.g. as shown in FIG. 1B) for receiving the charged particles 402.

Figure 2:
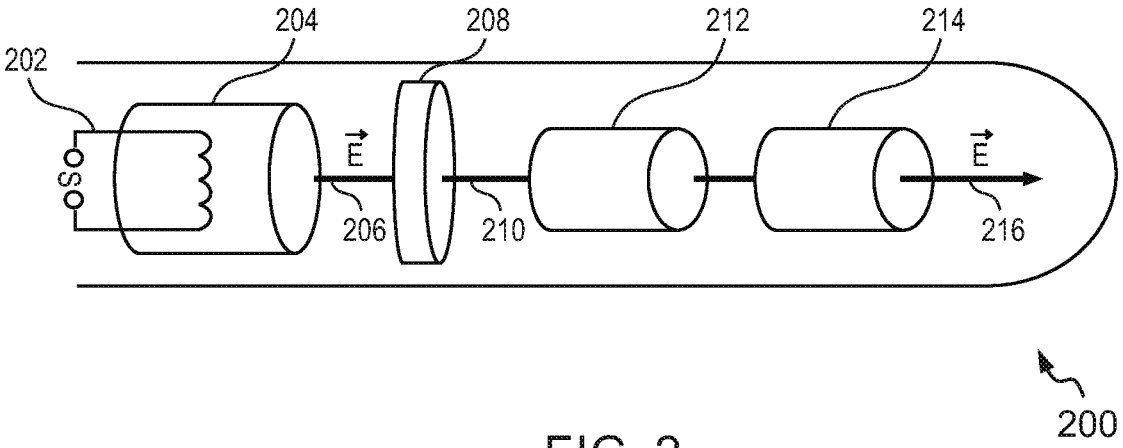
FIG. 2 illustrates a representation of a charged particle generator, in accordance with an example embodiment of the present disclosure

The charged particle generator 106 generates the charged particles 402, which may either be negatively charged such as electrons, or positively charged such as protons. In one embodiment, the charged particle generator 106 may be embodied as an electron gun (for e.g. as shown in FIG. 2) capable of generating the charged particles 402. The generated charged particles 402 are directed towards the force-generating element 102 for generation of the thrust force therein. In at least one example embodiment, the force-generating element 102 is a capacitive system including at least two surface conductors or electrodes (for example, an anode and a cathode with a di-electric material disposed therebetween). As the charged particles 402 are made available within one of the electrodes of the force-generating element 102, the charged particles 402 are deflected to a conducting surface (for example, electrons are deflected towards the anode) using an electric field by supplying voltage to the conducting surfaces of the capacitive system. Thereafter, an electric discharge (or a field emission scenario) is created by exceeding a field emission condition or a breakdown voltage of the dielectric material between the surface conductors, which results in the charged particles 402 gaining acceleration. The accelerated charged particles 402 move towards the conducting surface, which is configured to serve as an electromagnetic wave shielding surface. As a result of acceleration of the charged particles 402, a Rindler horizon is established behind the accelerating charged particles 402 and the accelerating charged particles 402 are also subjected to vacuum fluctuations in the front. State of the art publications are stating that under normal conditions, an accelerated particle may experience a maximum thermal Unruh radiation (peak wavelength) of approximately 8 times the maximum wavelength as confined in the Rindler horizon zone. Such a situation is by the state of art assumed to cause inertia. The embodiment of the apparatus is assumed to be changing the ground conditions of the inertial situation by influencing supplemental vacuum fluctuations by acceleration of embedded particles (i.e. Unruh radiation) and by confinement of overall frequency spectrum modification (i.e. also Casimir effect).

By reducing a predetermined distance of the dielectric material 306 in front of the accelerating charged particles 402 such that the confinement zone is less than the Rindler horizon distance from the accelerating charged particles 402, a maximum wavelength of QVO in the propagation direction is reduced. As a result of energy gradient in the region behind the accelerating charged particles 402 and in front of the accelerating charged particles 402, an inertial mass of each of the accelerating charged particles 402 is altered. To compensate the change in the inertial mass, a mechanical force is exerted in the propagation direction, which results in the creation of the thrust force, as per the law of conservation of momentum. The position of the attenuation material with respect to the location of initial acceleration (which is cathode in the present example) is proportional to the level and direction of the thrust created.

The thrust force generated by the thruster device 100 may be utilized to move objects connected to the thruster device 100. For example, the thruster device 100 is depicted to be connected to the vehicle 104. Some non-limiting examples of the vehicle 104 may include a spacecraft, an aircraft or any such vehicle. Accordingly, the thruster device 100 may facilitate propellant-less travel or transportation on Earth and in space. Further, the thrust to the spacecrafts may be used for space mining of asteroids, asteroid deflection and deep space traveling and colonization.

In one configuration, the field emission condition may include application of heat or liquids on the metal surface and/or utilization of the photoelectric effect for influencing charge liberation from the power source.

FIG. 2 illustrates a representation of an electron gun 200, in accordance with an example embodiment of the invention. The electron gun 200 is configured to generate charged particles 402, i.e. electrons, and is an example of the charged particle generator 106 explained with reference to FIG. 1B.

The electron gun 200 is depicted to include an Alternating Current (AC) or a DC power supply 202, a cathode 204, a control grid 208, an accelerating anode 212 and a focusing anode 214. Typically, the cathode 204 is surrounded by a filament (not shown in the FIG. 2), which is configured to receive power from the power supply 202. The power supply 202 supplies the cathode 204 with energy, which leads to the emission of electrons 206 from the cathode 204. After exiting from the cathode 204, the electrons 206 pass through the control grid 208. In one example embodiment, the control grid 208 is made up of nickel material. The control grid 208 is depicted to include a slot at the center and is co-axial with the central axis of the electron gun 200. The electrons 206 pass through the control grid 208, and conform to an electron beam 210. The intensity of the electron beam 210 received from the control grid 208 may depend on the number of electrons 206 emitted by the cathode 204. The electron beam 210 is directed towards the anode 212. The anode 212 is configured to accelerate the electron beam 210 via a high positive potential, applied across the accelerating anode 212. Lastly, the electron beam 210 is focused by the focusing anode 214 prior to discharge of the electrons as a beam 216.

FIG. 3 illustrates a representation of the force-generating element 102, in accordance with an example embodiment of the invention. As explained with reference to FIG. 1, the thruster device 100 may include only the force-generating element 102 and, as such, the force-generating element 102 as explained hereinafter, may, in at least some embodiments, imply the thruster device 100.

The force-generating element 102 (or the thruster device 100) may be a capacitive system including two electrodes a first electrode 302 and a second electrode 304 mounted to the housing 320. The housing 320 may be an enclosure, configured in the object for encompassing the force-generating element 102. The first electrode 302 includes a first longitudinal axis A-A'. The second electrode 304 includes a second longitudinal axis B-B' which is oriented in parallel to the first longitudinal axis A-A'. The first electrode 302 and the second electrode 304 are spaced apart by a predetermined distance. This configuration conforms to a parallel plate capacitor. The first electrode 302 is electrically connected to a first terminal 308 (e.g., negative terminal) of a power source 312, while the second electrode 304 is electrically coupled to a second terminal 310 (e.g., positive terminal). The first electrode 302 may be a cathode electrode, and as such may be connected to the negative terminal 308 of the power source 312. The second electrode 302 may be an anode electrode, and as such may be connected to the positive terminal 310 of the power source 312. In one configuration, the power source 312 is configured to provide required voltage or maintain a required electric field for enabling acceleration of the charged particles 402 from the first electrode 302 and the second electrode 304.

A dielectric medium 306 is included between the first electrode 302 and the second electrode 304. The dielectric medium 306 may be configured in the predetermined distance between the first electrode 302 and the second electrode 304. The dielectric medium 306 may extend beyond the lengths of the electrodes 302 and 304, for ensuring distribution between the electrodes 302 and 304. In one configuration, the dielectric medium 306 is oriented in parallel with the electrodes 302 and 304. Some non-exhaustive examples of the dielectric medium 306 may include vacuum, Low Density Polyethylene (LDPE) plastic, High Density Polyethylene (HDPE) plastic and Mylar. In some embodiments, a thickness of the dielectric medium 306 may range from 3 micrometers to 200 micrometers. Also, the force-generating element 102 may be wrapped with an insulating material 314, such as for example, insulating tape, to preclude any electric leakage from the thruster device.

It is noted that the force-generating element 102 may be configured in various ways and the configuration depicted in FIG. 3 is shown for illustration purposes. For example, in some embodiments, instead of a parallel plate capacitor, a needle to plate construction (not shown in Figures) with vacuum or insulating gas, liquid or other matter as the insulating dielectric material may also be used to increase the electric field strength. A vacuum may provide a steady stream of electrons which also could be modulated. This would enable a low capacitance value and a very fast "tau" charge time (almost immediate), thereby "firing" a spark discharge directly with the controlled pulse, in effect providing an "ON" period which could also establish pulse width modulation (PWM). The thrust force may be reduced by this factor (as determined by force per pulse multiplied by number of pulses). Additionally, shape and configuration of the second electrode 304 (or the anode electrode) may be modified for allowing a greater intensity of vacuum fluctuations which oppose the propagation direction and the accelerated mass inside the capacitor and could decrease the thrust in this manner. A changing variable second electrode distance may also help control thrust values at fixed voltage and current during operation. This may also be extended to the first electrode 302 for varying the number of charged particles 402 in the circuit. In one configuration, a positioning mechanism 318 may be connectable to at least one of the first electrode 302 and the second electrode 304 for altering the predetermined distance therebetween. As such, the positioning mechanism 318 is configured to operate the at least one of the first electrode 302 and the second electrode 304 for adjusting the predetermined distance therebetween. In one configuration, the positioning mechanism 318 may be a stepper-motor mechanism (not shown in Figures), configured to be connectable to at least one of the first electrode 302 and the second electrode 304 for adjusting the predetermined distance therebetween. The stepper motor mechanism may include a stepper motor coupled to a gear mechanism. The gear mechanism may be configured to convert the rotational motion of the stepper motor into a linear displacement, thereby adjusting the position of at least one of the first electrode 302 and the second electrode 304, thereby adjusting the predetermined distance therebetween. This configuration may also be combined with the general controller which controls acceleration voltage and current (by modulation such as (PWM) pulse width modulation as an example). Furthermore, the second electrode 304 can change thicknesses or the dimensions of the second electrode 304 may be altered according to the radiation attenuation requirements. In one implementation, the dimensions of the second electrode 304 is configured to be larger than the first electrode 302 for shielding of the electromagnetic radiations, during operation of the force-generating element 102.

The functioning of the force-generating element 102 is hereinafter explained using the electrons as the charged particles 402. It is noted that the charged particles 402 may not be limited to electrons and may include any type of charged particle (protons, for example). Accordingly, the force-generating element 102 is configured to accelerate the stream of electrons in order to generate the thrust force.

In an embodiment, a voltage is supplied to the first electrode 302 (i.e. the cathode electrode, hereinafter referred to as 'cathode 302') and the second electrode 304 (i.e. the anode electrode, hereinafter referred to as 'anode 304'), such that an electric field is established between the electrodes. On establishing the electric field, the cathode 302 generates a stream of electrons. As such, a stream of charged particles 402 is available at the cathode 302 upon establishing the electric field. The charged particles 402 that are attracted towards the anode 304 (for e.g. as shown in FIG. 4A), however, are held in place near the cathode 302 due to the resistance offered by the dielectric medium 306. The electric field is gradually increased such that it exceeds the breakdown voltage or the field emission condition of the electrodes 302 and 304. The breakdown voltage causes the dielectric medium 306 to conduct the charged particles 402, thereby resulting in acceleration of the electrons towards the anode 304. As information from behind the electrons never catches up with the accelerating electrons (i.e., a non-seeing zone is formed behind a point), so from the electron's point of view, space-time ends there and a Rindler horizon forms behind the accelerating electrons. Further, virtual particles at the horizon are split and the accelerating electrons experience QVO as they accelerate towards the anode 304, which tries to oppose the acceleration of the electrons. By attenuating the oscillations (i.e., by confining in causality to reduce the allowed wavelength below the natural level), the maximum wavelength of the oscillations is reduced. Attenuation of the oscillation is achieved when the distance travelled by the accelerating electrons between the cathode 302 and the anode 304 is reduced gradually. Due to the process of wave attenuation, a gradient is formed and which results in a change in the inertial mass of each of the accelerated electrons. To compensate the change in the inertial mass, the force-generating element 102 exerts a mechanical force or moves in the direction of anode 304 to conserve the momentum, thereby acquiring the thrust force required to propel the vehicle 104.

Figure 4B:
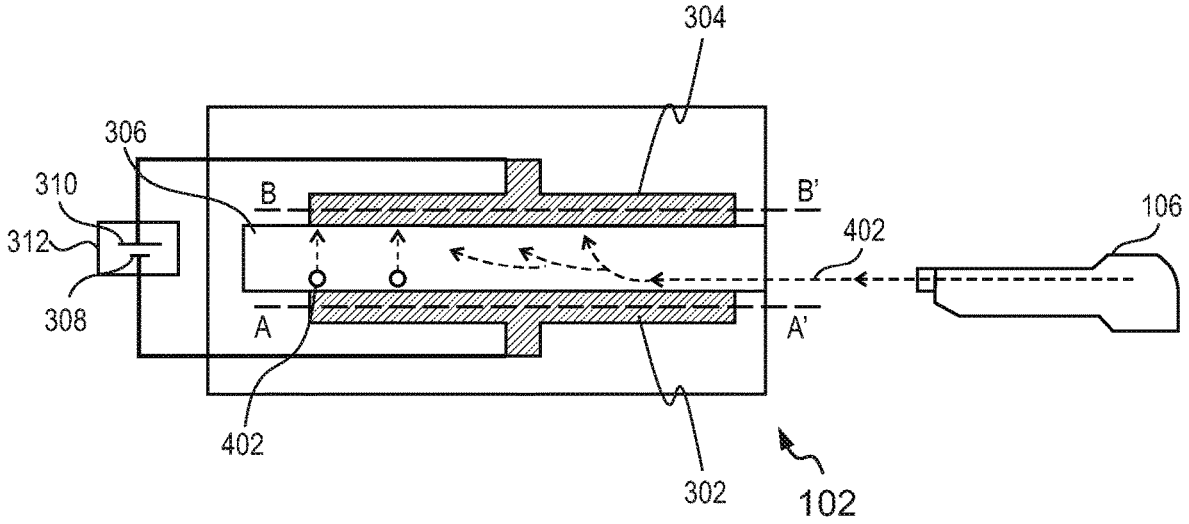
FIG. 4B illustrates a representation of acceleration of the charged particles generated by the first electrode and the charged particles received from the charged particle generator under the influence of the electric field, in accordance with an example embodiment of the present disclosure.

Referring to FIG. 4B, apart from utilizing the charged particles 402 generated from the cathode 302, the charged particles 402 may be supplied by the charged particle generator 106 (for e.g., an electron gun 200 shown in FIG. 2). This configuration ensures higher density of the charged particles 402 (for e.g. as shown in FIG. 4B) available at the cathode 302, thereby increasing the density of the accelerated charged particles 402. Consequently, increasing the thrust force generated by the force-generating element 102. Moreover, due to the supply of charged particles 402 by the charged particle generator 106, the electric field required to be maintained between the electrodes 302 and 304 may be reduced considerably. In other words, the electric field required to be maintained for generation of charged particles 402 by the cathode 302 may be alleviated.

Figure 5:
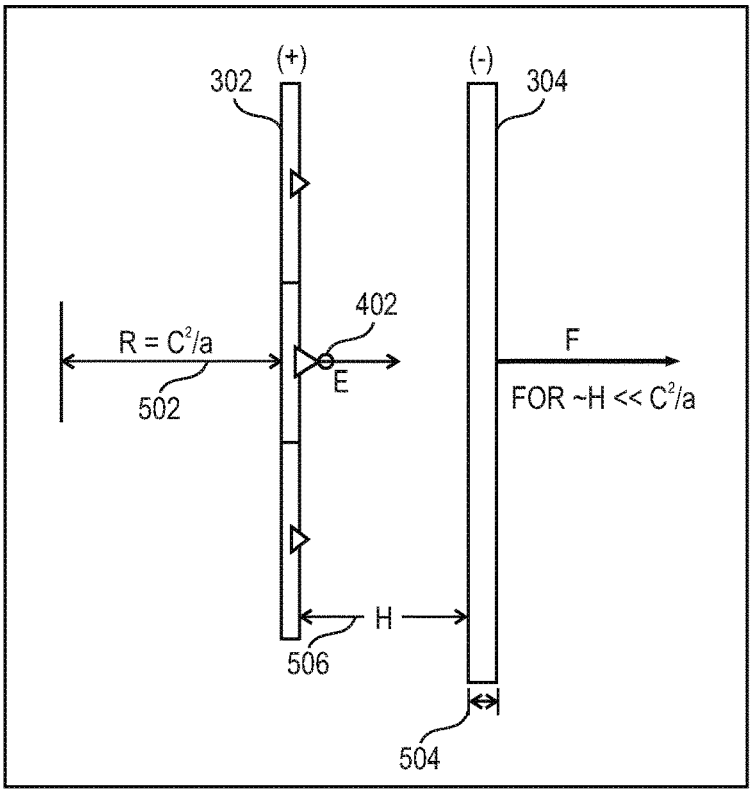
FIG. 5 illustrates a cross-sectional view of a thruster device for illustrating the creation of a thrust effect, in accordance with an example embodiment of the present disclosure.

Referring now to FIG. 5 in conjunction with FIGS. 4A and 4B, the electrons emitted from the electron gun 200 enter the force-generating element 102 as the electron beam 216. Once the electron beam 216 enters the force-generating element 102, the electrons are initially deflected by an electric field between the electrodes 302 and 304. Upon reaching the breakdown voltage or field emission condition, the dielectric material 306 converts into a path through the insulating material resulting in (high) acceleration of the electrons. The accelerated electrons impinge or hit the anode 304, and travel through the anode 304. It is noted that the thrust force is proportional to the density or the number of electrons that are accelerating between the cathode 302 and the anode 304. The acceleration of the electrons leads to creation of the Rindler horizon 502 behind the electrons. The electrons experience vacuum fluctuations at the front to oppose the acceleration. The fluctuations are attenuated due to the predetermined distance 506 (see, H) configured between the electrodes 302 and 304. The attenuation (with an exponential influence for the energy state) of the vacuum fluctuations result in change in the inertial mass of the electrons causing generation of the thrust force (see, F). In one implementation, factors such as but not limiting to a current applied, a voltage applied, an input power applied, shape and configuration of the force-generating element 102, and the like, may control the thrust force generated.

In one embodiment, voltage and/or temperature of the electron gun 200 can be high and the voltage of the force-generating element 102 can be comparatively low. Due to such voltage differences, the Rindler horizon 502 in the acceleration field can be longer. Moreover, by achieving a fixed horizon length the attenuation factor for attenuating the vacuum fluctuations can be increased exponentially. Such attenuation further results in the enhancement of the thrust force (F).

In one implementation, it is noted that the high voltage (HV) power supply in the force-generating element 102 may be controlled to provide a flat DC supply or other output like PWM (pulse width modulation) or a rectified output (half wave, full half wave) as available in standard technologies for power supplies or motor drive circuits. It is noted that the voltage level is correlated to the acceleration of the electrons in the electric field. Furthermore, the output can provide a duty cycle which influences the thrust force (F) as established on the average, per second.

As mentioned earlier, one of the factors for controlling the thrust force (F) is the dimensions of the device, such as for example the shape and size of the electrodes 302 and 304. The effect of some example variations in the structure and dimensions of components of the force-generating element 102 is explained in detail in subsequent paragraphs.

In one implementation, the electrodes 302 and 304 are configured to be conductive materials, suitable for allowing the charged particles to pass through. In one configuration, the electrodes 302 and 304 may be made of materials such as but not limiting to aluminum steel, copper, graphene or any other suitable materials as per design feasibility and requirement.

In one configuration, the electrodes 302 and 304 may be configured to be a plate-like structure made of conductive materials as per requirement. In another configuration, the electrodes 302 and 304 may conform to any geometric shape as per design feasibility and requirement.

Figure 6:
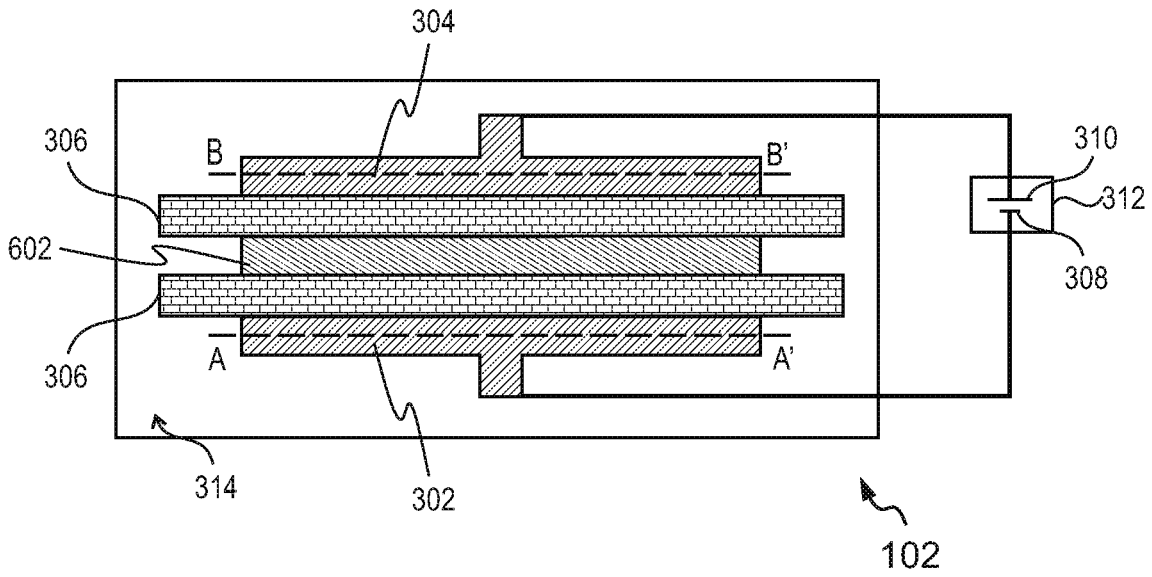
FIG. 6 illustrates a representation of the force-generating element with at least one floating electrode, in accordance with an example embodiment of the present disclosure.
Figure 7:
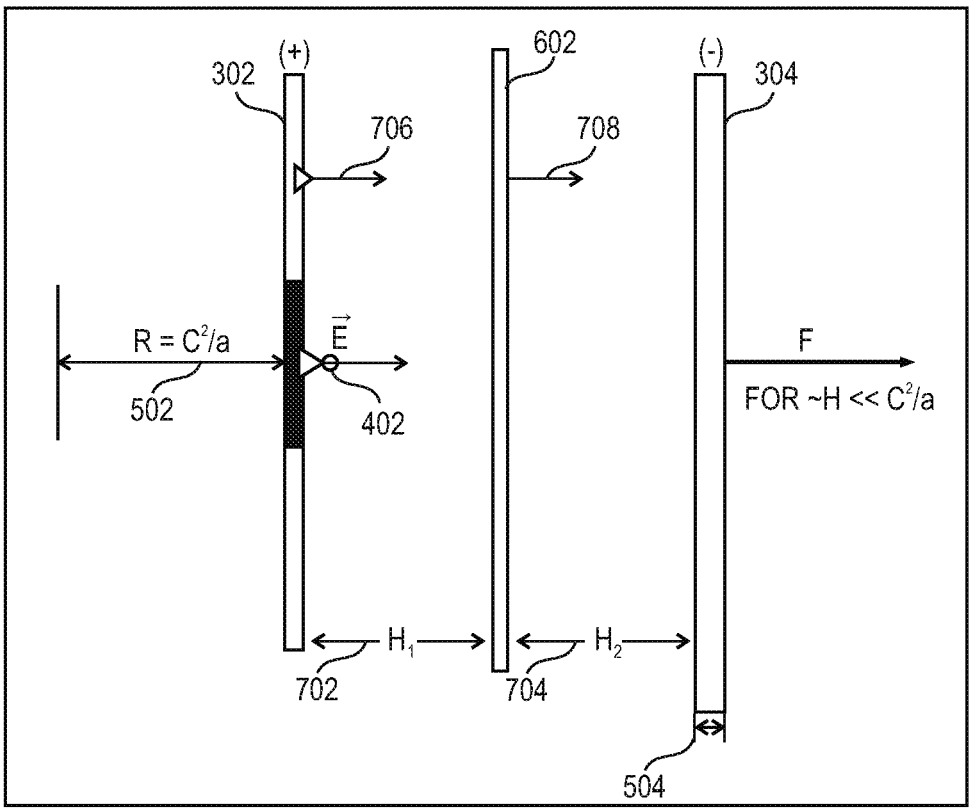
FIG. 7 illustrates a cross-sectional view of the thruster device with the force-generating element of FIG. 6 for illustrating the creation of a thrust effect, in accordance with another example embodiment of the present disclosure.

FIG. 6 illustrates a representation of the force-generating element 102 configured with at least one floating electrode 602, in accordance with another example embodiment of the invention. In this configuration of the force-generating element 102, the at least one floating electrode 602 is disposed between the electrodes 302 and 304. More specifically, the at least one floating electrode 602 is suspended between the electrodes 302 and 304. In the illustrated embodiment, the floating electrode 602 is oriented parallelly to the electrodes 302 and 304. As such, the dielectric medium 306 is disposed between the floating electrode 602 and the electrodes 302 and 304, suitably. As such, the predetermined distance 316 may be suitably divided into distance 702 (see, $H_1$) and distance 704 (see, $H_2$) as shown in FIG. 7. The distances 702 and 704 may be selected or adjusted suitably as per design feasibility and requirement. The floating electrode 602 may also be coupled to the positioning mechanism 318 for enabling adjustment of its position in the force-generating element 102. In one configuration, the floating electrode 602 may also be disposed outside the electrodes 302 and 304. In one configuration, the floating electrode 602 may be connected to the cathode 302. The floating electrode 602 may be a conductive material, identical to the electrodes 302 and 304 and configured to allow the charged particles 402 to pass through. The floating electrode 602 may be surrounded by an insulating layer (not shown in Figures), for insulation from the electromagnetic radiations emanating during operation of the force-generating element 102. Further, based on the composition of the floating electrode 602, the thrust force generated by the force-generating element 102 may vary, as the Rindler horizon may correspond to the configuration of the floating electrode 602. More specifically, by connecting the floating electrode 602 to the cathode 302, (derived by empirical research) the thrust force generated towards the anode 304 may be modified. This is due to the phenomenon that, the Rindler horizon is affected due to the variation observed in the acceleration of the charged particles 402, when passing through the floating electrode 402 (for e.g. as shown in FIG. 7), which inherently affects the vacuum fluctuations impinged on the charged particles 402.

In another configuration, the floating electrode 602 may be connected to the anode 404 (but not in between the cathode 302 and the anode 304), and using the same logic as described above, the force effect may be modified. In general, the reduction in the overall probability zone of the localized particle associated with the vacuum fluctuations which is located between the Rindler horizon and the cathode 302, causes a modified thrust effect. It is noted that at full cancellation of the Rindler horizon (i.e. blocking of all generation of virtual particles) with the floating electrodes 602, the force-generating element 102 may reverse its thrust force towards the cathode 302.

In one embodiment, a shape and configuration of the cathode 302 may determine the generated thrust force. Furthermore, if the cathode 302 is thick enough such that the Rindler horizon is completely blocked, then normal localization outside of conductive material of the virtual particles associated with the vacuum fluctuations is fully eliminated, and the thrust will reverse in the direction towards the cathode 302.

Referring to FIG. 7 in conjunction with the FIG. 6, when the charged particle 402, accelerates from the cathode 302 to the anode 304, the thrust effect (F) or motion exerts in the direction of the anode 304. Due to the positioning of the floating electrode 602, the electrons accelerating from the cathode 302, is accelerated for the second time (the second acceleration is shown as acceleration 708, whereas the first acceleration is shown as acceleration 706) upon impact with the floating electrode 602. The resulting force or the thrust effect (F) is thus multiplied in proportion to the number of stacked floating electrodes 602 disposed in the force-generating element 102.

Figure 8:
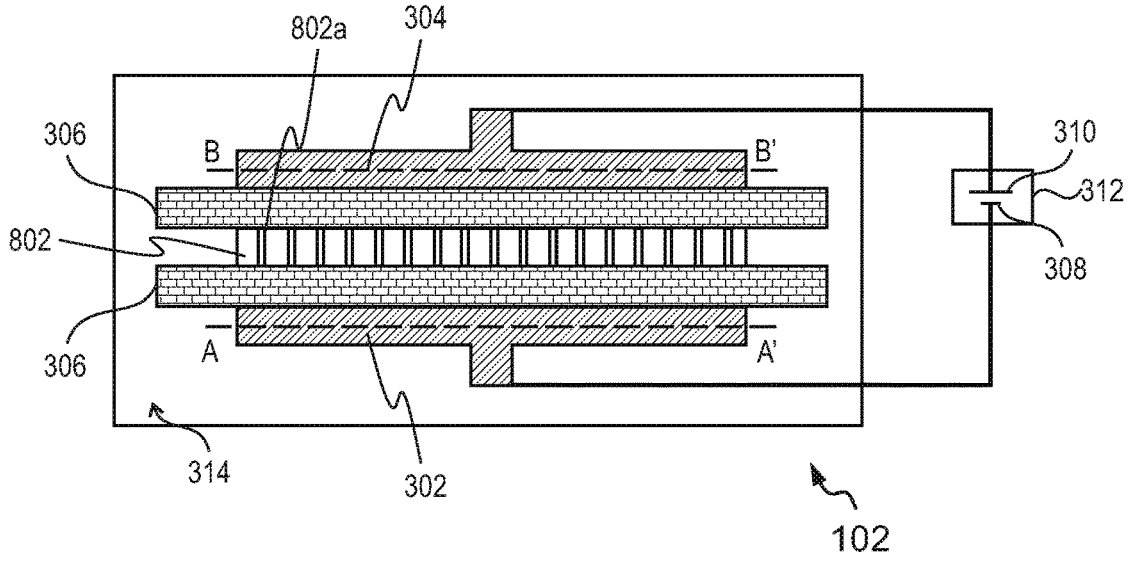
FIG. 8 illustrates a representation of the force-generating element with at least one mesh conductor, in accordance with an example embodiment of the present disclosure.
Figure 9:
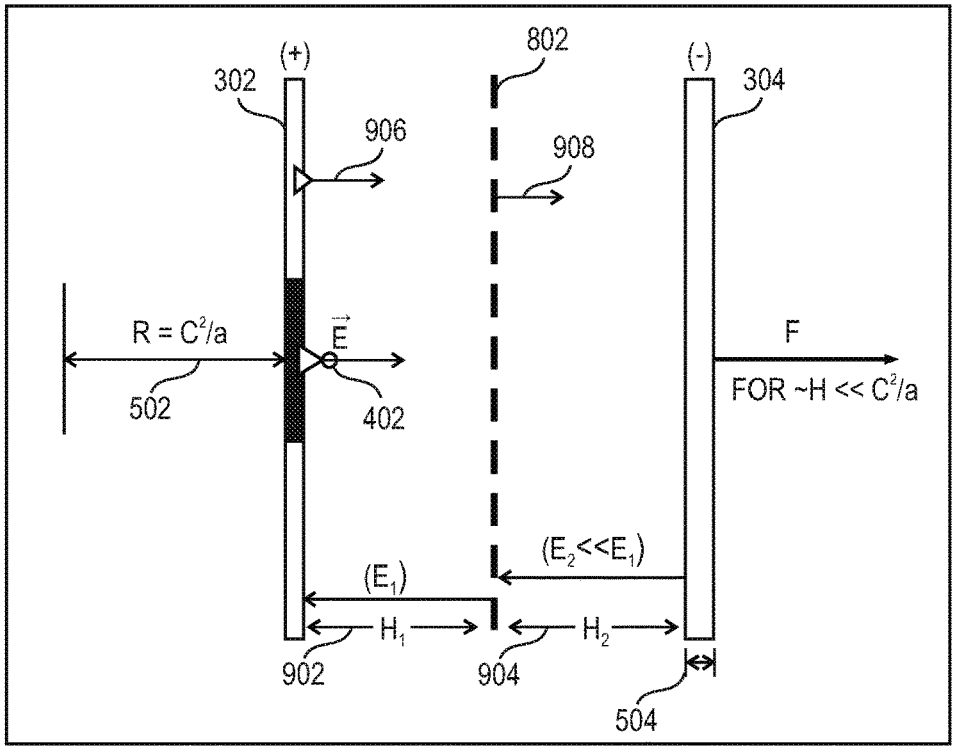
FIG. 9 illustrates a cross-sectional view of the thruster device with the force-generating element of FIG. 8 for illustrating the creation of a thrust effect, in accordance with another example embodiment of the present disclosure.

FIG. 8 illustrates the force-generating element 102 configured with a mesh conductor 802, in accordance with an example embodiment of the present disclosure. In this embodiment, at least one mesh conductor 802 is disposed between the electrodes 302 and 304. In the illustrated embodiment, the mesh conductor 802 is oriented parallelly to the electrodes 302 and 304. More specifically, the mesh conductor 802 may be suspended between the electrodes 302 and 304. As such, the dielectric medium 306 is disposed between the mesh conductor 802 and the electrodes 302 and 304, suitably. Therefore, the predetermined distance 316 may be divided suitably into distance 902 (see, $H_1$) and distance 904 (see, $H_2$) as shown in FIG. 9. The distances 902 and 904 may be selected or adjusted suitably as per design feasibility and requirement. The mesh conductor 802 may also be coupled to the positioning mechanism 318 for enabling adjustment of its positioned in the force-generating element 102. In one configuration, the mesh conductor 802 may also be disposed outside the electrodes 302 and 304. In one configuration, the mesh conductor 802 may be connected to the cathode 302. The mesh conductor 802 may be a conductive material, identical to the electrodes 302 and 304 and configured to allow the charged particles 402 to pass through. The mesh conductor 802 may also be surrounded by an insulating layer (not shown in Figures), for insulation from the electromagnetic radiations emanating during operation of the force-generating element 102. Further, based on the configuration of the mesh conductor 802, the thrust force generated by the force-generating element 102 may vary, as the Rindler horizon may correspond to the configuration of the mesh conductor 802. This is due to the phenomenon that, the Rindler horizon is affected due to the variation observed in the acceleration of the charged particles 402, when passing through the mesh conductor 802 (for e.g. as shown in FIG. 9), which inherently affects the vacuum fluctuations by horizon radiation impinged on the charged particles 402. In one configuration, the mesh conductor 802 includes a plurality of pores 802*a*, which act as an insulation for movement of the charged particles 402 therein. This ensures that the charged particles 402 are streamlined before contacting the anode 304. This may inherently affect the virtual particles or discrete vacuum fluctuated waves, thereby affecting the thrust generated by the force-generating element 102. The mesh conductor 802 is configured to boost the thrust force generated based on quantized inertia.

Referring to FIG. 9 in conjunction with FIG. 8, when the charged particle 402 accelerates from the cathode 302 towards the anode 304, the thrust effect (F) or force exerts in the direction of the anode 304. The charged particle 402 accelerated from the cathode 302 hits the mesh conductor 802 before reaching the anode 304. The acceleration of the charged particles 402 includes one initial acceleration stage (shown as an acceleration 906) with high electric field strength (shown as E1), where the initial acceleration stage being the region between the cathode 302 and the mesh conductor 802. The second stage, between the mesh conductor 802 and the anode 304, has a much lower electric field strength (shown as E2 and E2<<E1). Hence the charged particles 402 experience a lower level of acceleration (shown as an acceleration 908). The lower level of acceleration results in the Rindler horizon distance 502 'R' being longer and a maximum allowed vacuum radiation wavelength in the propagation direction. This configuration ensures that the oscillations are attenuated due to the position of the anode 304, resulting in a higher thrust force or a force gradient. In one configuration, the intensity of the electric fields $E_1$ and $E_2$ may be selected as per design feasibility and requirement.

Figure 10:
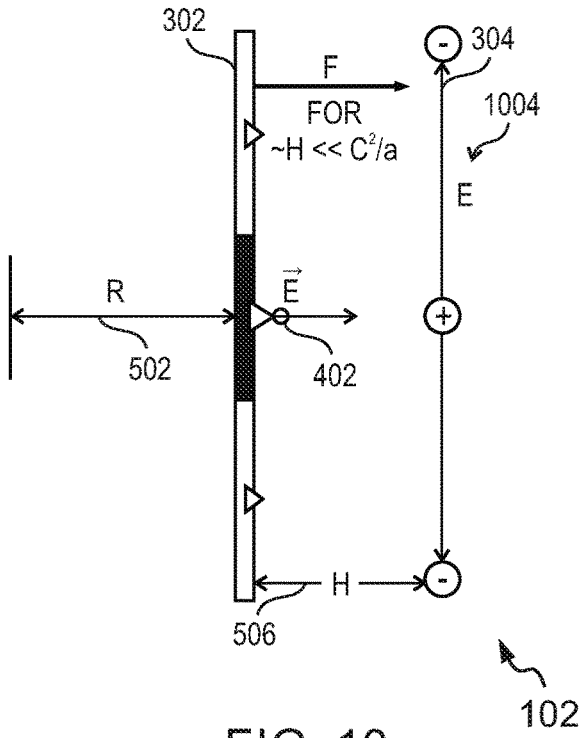
FIG. 10 illustrates a representation of the force-generating element with a fractal antenna for field concentration, in accordance with an example embodiment of the present disclosure.
Figure 11:
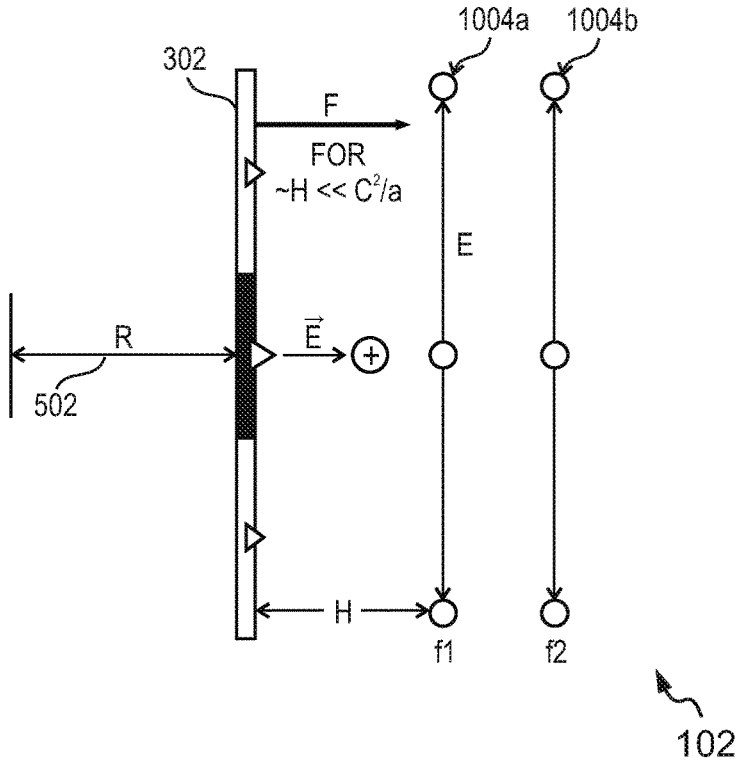
FIG. 11 illustrates a representation of the force-generating element with the fractal antenna for field concentration, in accordance with another example embodiment of the present disclosure.

FIG. 10 illustrates the force-generating element 102 configured with at least one fractal antenna 1004, in accordance with an example embodiment of the present disclosure. In this configuration, the anode electrode 304 is replaced with the at least one fractal antenna 1004. Thus, the fractal antenna 1004 behaves as the anode 304 for the force-generating element 102. The fractal antenna 1004 is configured with a high electric field strength. The fractal antenna 1004 enables modulating frequencies of the accumulated waves (shown as 'f1' and 'f2' in FIG. 11) for destructive interference of the vacuum fluctuations which influence radiation. The high electric field strength corresponds to a shorter predetermined distance H between the cathode 302 and the fractal antenna 1004. Due to the high electric field strength, the charged particles 402 accelerate towards the fractal antenna 1004. Due to the acceleration of the electrons towards the fractal antenna 1004, the Rindler horizon 502 is established. Further, due to the shorter predetermined distance H between the cathode 302 and the fractal antenna 1004 and the destructive interference, the vacuum fluctuations acting on the charged particles 402 reduces, thereby generating the thrust force. In one configuration, two fractal antennas 1004*a*, 1004*b* may be mounted parallelly to the cathode 302 (for e.g. as shown in FIG. 11). Similar to the configuration of the floating electrode 602 and the mesh conductor 802, the provision of multiple fractal antenna 1004*a*, 1004*b* boost the thrust force generated in the force-generating element 102. In one configuration, the electric field intensity of the fractal antennas 1004*a*, 1004*b* may be varied as per the required thrust force. In another configuration, the fractal antenna 1004 may be selected to one of a resonating Koch or a Sierpinski or any other configuration as per design feasibility and requirement.

Figure 12A:
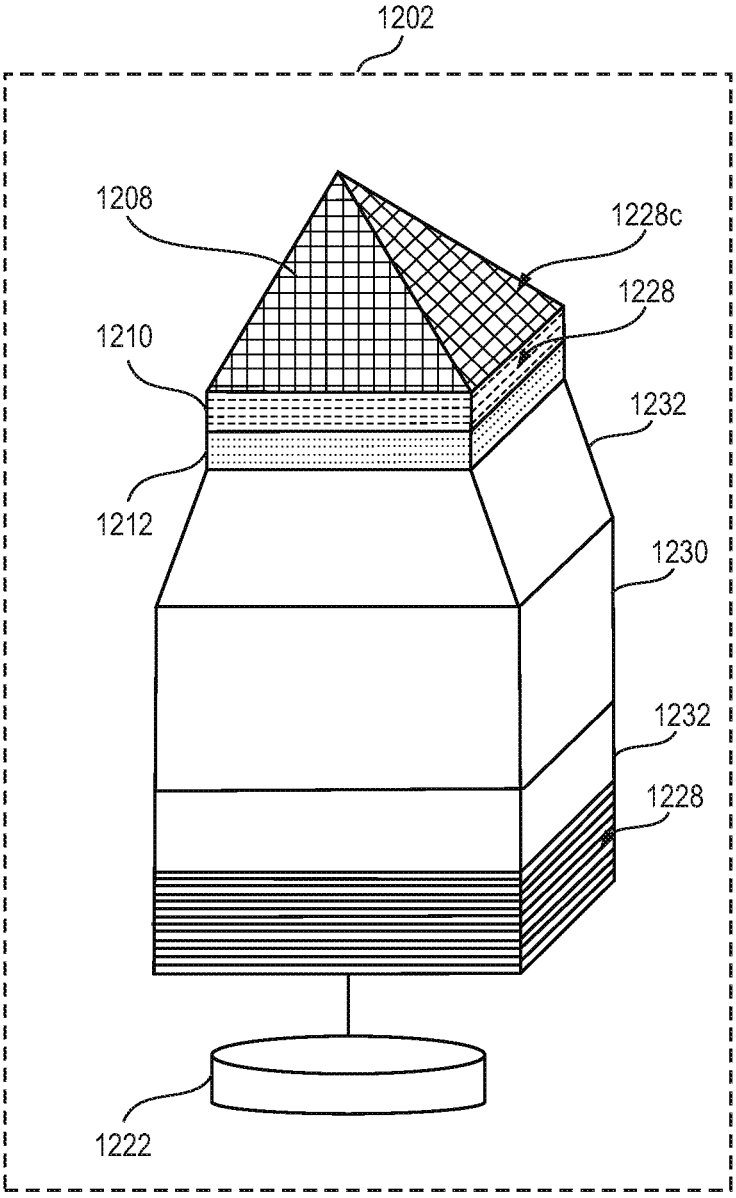
FIG. 12A illustrates configuration of the thruster device for use in a propelling vehicle, in accordance with an example embodiment of the present disclosure.
Figure 12B:
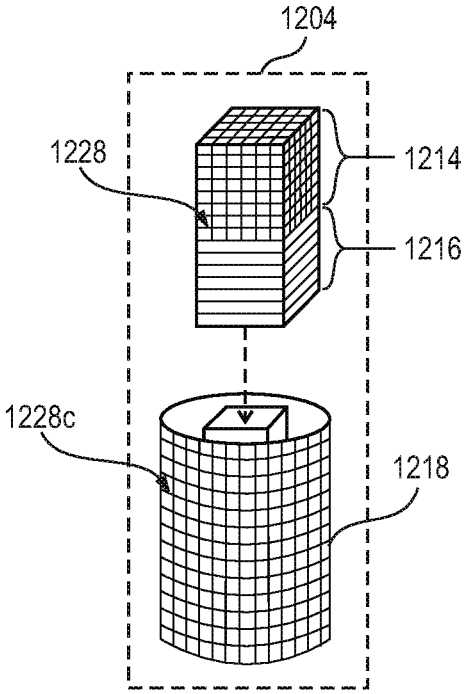
FIG. 12B illustrates configuration of the thruster device for use in the propelling vehicle, in accordance with another example embodiment of the present disclosure.
Figure 12C:
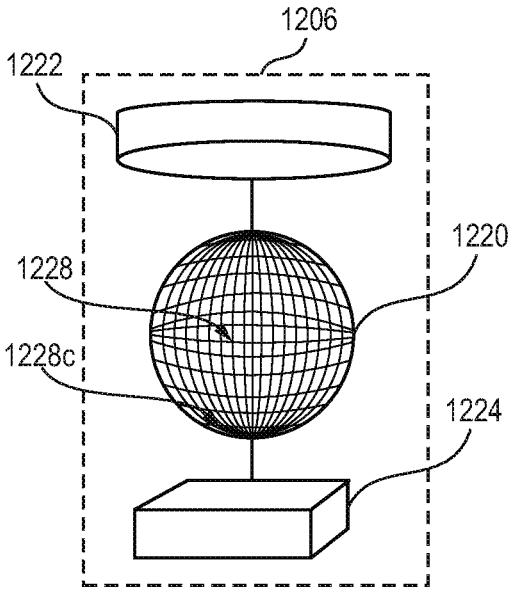
FIG. 12C illustrates configuration of the thruster device for use in the propelling vehicle, in accordance with another example embodiment of the present disclosure.

FIGS. 12A-12C illustrate various configurations of the thruster device 100 for use in the vehicle 104, in accordance with an example embodiment of the present disclosure. It is noted that multiple force-generating element 102 (or a plurality of force-generating elements 1228), may be stacked on top of each other and next to each other as per design feasibility and requirement for maximizing efficiency, performance and reliability. Consequently, this would result in a cumulative thrust effect or thrust force to act on the vehicle 104. The plurality of force-generating elements 1228 may conform to a cell-like structure or a grid-like structure. As such, the plurality of force-generating elements 1228 may be hereinafter referred to as capacitive thruster device (CTD) cells 1228. An upward CTD cell (not shown in Figures) may imply an anode terminal, whereas a lower CTD cell may imply a CTD cell having the cathode terminal. The stacking of upward and/or downward CTD cells in any specific manner creates a CTD cell panel and stacking of multiple CTD cell panels is referred to as a CTD cell grid.

The CTD cell grids may be attached not only to space vehicles but to any moving vehicle. A power supply and control unit 1232 (for e.g. as shown in FIG. 12C) along with a control grid may control the operation of the CTD cell grid suitably, based on requirement. Additionally, layers of CTD cell panels may provide thrust in both directions so one layer may provide thrust in forward direction and the next layer may provide thrust in the other direction (not shown in Figures). Such flexibility allows travel in all directions and additionally allows very sensitive directional travel based on shapes and configurations of the CTD cell grids. Accordingly, three thruster device configurations are shown as configuration 1202, configuration 1204 and configuration 1206 in FIGS. 12A, 12B and 12C, respectively. In one configuration, the CTD cells may be arranged based on the direction of the thrust force generated by each of the plurality of force-generating elements 1228 positioned therein. As such, the plurality of force-generating elements 1228 may be configured such that, the elements 1228 for propelling the vehicle 104 in a straight line may be positioned in a central portion of the vehicle 104, while the elements 1228 required for manoeuvring the vehicle 104 is mounted around the periphery or corners of the vehicle 104.

In the configuration 1202, the thruster device 100 includes a CTD cell grid 1208 associated with a pyramid shade for directional control or manoeuvring, and two more CTD cell panels, i.e. a CTD cell panel 1210 and a CTD cell panel 1212 capable of providing upward and downward thrust, respectively. An additional CTD cell stack 1230 also aids in movement, for providing greater thrust forces for propelling the vehicle 104. The configuration 1202 is also associated with power supply and control unit 1232. The power supply and control unit 1232 is communicably coupled with the cell stacks 1210, 1212 and 1230, for ensuring control over the device for propelling the vehicle 104 as desired. The power supply and control unit 1232 may include all the necessary electronics for controlling the operation of the cell stacks 1210, 1212 and 1230. In an embodiment, CTD cells (e.g., cell stacks 1210, 1212 and 1230) can be arranged to be incorporated as part of the hull (e.g., housing 320) of a vehicle, inside the craft or detached (mechanical connected) to the craft. This includes provision of mounting a block (unit) of CTD cells on movable axis (to allow rotation and adjust the force direction).

In the configuration 1204, the thruster device includes a CTD cell grid 1214 and a CTD cell grid 1216 disposed on top of one another to configure a block structure. The configuration 1204 further includes a cylindrical CTD cell grid 1218 for directional steering. In some embodiments, the cylindrical CTD cell grid 1218 surrounds the cell grids 1214 and 1216 for ensuring better control over the movement of the vehicle 104.

In the configuration 1206, the thruster device includes a spherical CTD cell grid 1220 capable of facilitating precise small movements. Each CTD cell grid may internally contain additional CTD cells and each CTD structure may be attached with a power supply 1222 shown in configurations 1202 and 1206, and a control grid 1224 for controlling operation of the vehicle 104. As already explained, elements 1228*c* are mounted along the periphery of the cell grid 1220 for ensuring manoeuvring.

Figure 13A:
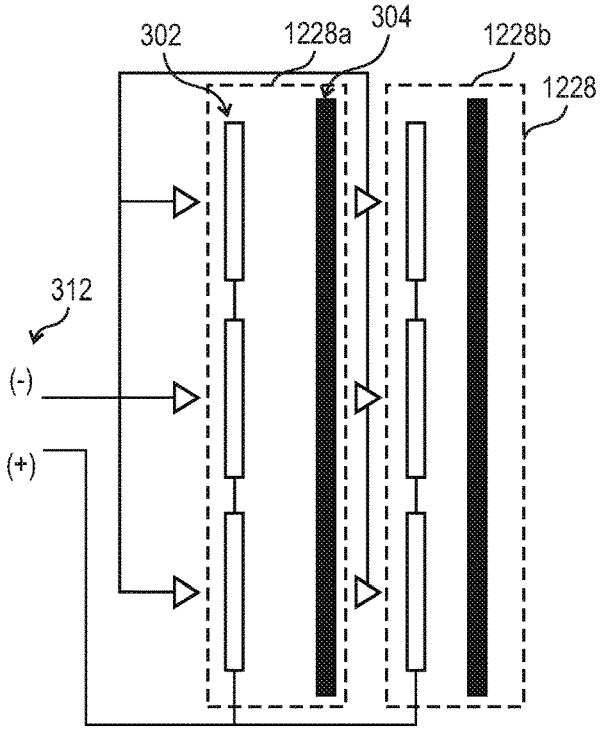
FIG. 13A illustrates a simplified representation of supply paths to a modular arrangement of discharge and beam acceleration segments, in accordance with an example embodiment of the present disclosure.
Figure 13B:
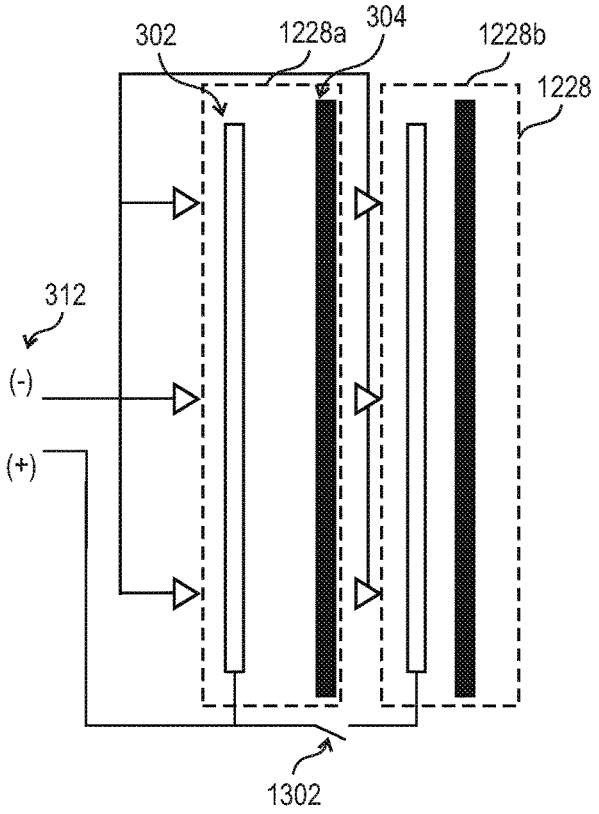
FIG. 13B illustrates a simplified representation of supply paths to a modular arrangement of discharge and beam acceleration segments, in accordance with another example embodiment of the present disclosure.

In an embodiment, the CTD cell stacks in the configuration 1202, 1204 and 1206 or the thruster device 100 may be stacked in a serial electrical connection or in a parallel electrical connection (as shown in FIGS. 13A and 13B), based on feasibility and requirement. As such, the elements 1228 may contain an element 1228*a* and an element 1228*b*, which can be connected either in series or in parallel electrical connection (as shown in FIGS. 13A and 13B). In one configuration, polarities (−) and (+) of the power supply 312 may be modulated. One example is pulse width modification or PWM. The selection of electrical connection of the CTD cell stacks enable configuring the elements 1228 suitably, for better control over the thrust force. In another configuration as shown in FIG. 13B, a switch 1302 may be configured in the connection lines between the elements 1228*a* and 1228*b*. It is noted that only one switch 1302 is shown for illustration purposes and that such a modular design may include one or more switch devices and branching supply circuits.

In one configuration, the cathode 302 may be split into segments (for e.g. as shown in FIGS. 13A and 13B) and moreover, the segments could be fired simultaneously or in sequence, as per design feasibility and requirement.

The dis-connectors or switch devices in the individual supply paths, such as switch 1302 shown in FIG. 13B, allow the control of simultaneous force events (i.e. events related to discharge and beam acceleration).

In one embodiment, the force-generating element 102 may be supplied with high voltage DC source (as shown in the FIG. 3). The connection of the DC source may be carried out by connecting a simple circuit where DC voltage source is connected in series with capacitor. At high DC voltage, the thickness of the dielectric material decreases, and the breakdown strength of the dielectric material is exceeded. Such increase in the breakdown voltage stimulates the electron 402 (i.e., the charged particles 402) to accelerate from the cathode 302 to the anode 304. The electron 402 gaining the acceleration leads to a creation of the Rindler horizon 502 behind the electron 402 as the information from beyond a point/horizon does not reach the accelerating electron 402). The Rindler horizon 502 is depicted to be at distance 'R', where the value of R may be obtained using equation (1):

$$R = c^2/a \qquad \text{Equation (1)}$$

where $c = 3\times10^8$ meters/second (i.e. speed of light) and 'a' is the acceleration of the charged particles, i.e. electron 402. The electron 402 experiences Unruh radiation and vacuum fluctuations as it accelerates towards the anode 304 on account of splitting of the virtual particles at the horizon. The anode 304 depicted to be at a distance 506 'H' from the cathode 302 configures the confinement zone. It is noted that the thickness 504 of the anode 304 (as shown in FIG. 5) is associated with a skin-depth attenuation factor of a wavelength approximately 8 times of the same wavelength which will fit into the Rindler horizon distance 'R'. The vacuum fluctuations can be attenuated, maximum wavelength of the oscillations accommodated within the confinement zone may be reduced by gradually reducing the distance 506 'H' such that the following equation (2) is satisfied:

$$H << c^2/a \qquad \text{Equation (2)}$$

On account of unsymmetrical Casimir radiation which result from the addition of the vacuum fluctuations by the Rindler horizon in the confinement zones of constructional 506 (H) and physical Rindler horizon 502 distance (R), there is a change in the inertial mass of the electrons. To compensate the change in the inertial mass, the force-generating element 102 exerts mechanical force or moves in the direction of anode 304 (i.e. the thrust direction is in propagation direction) to conserve the momentum. The thrust direction is shown as 'F' (for e.g. as shown in FIG. 7). The resulting thrust force may be enhanced by modifying the capacitive arrangement within the force-generating element 102. For example, multiple capacitors in series may be stacked on top of each other in order to potentially boost effect.

The benefits and advantages described above may relate to one embodiment or may relate to several embodiments. The embodiments are not limited to those that solve any or all of the stated problems or those that have any or all of the stated benefits and advantages. Various embodiments of the present disclosure can be implemented as thruster devices in aircraft, rockets, space elevators (position control), satellites, space probes and the like. For instance, embodiments of the present disclosure provide propulsion devices on planet or moons with no atmosphere. Further, thruster devices can be used in asteroid flight path modification where a thruster device with a fixation system could change the flight path. Further, stacked CTD cell units provide the advantage to be able to electrically disconnect malfunctioning segments. This provides a means for selectively isolating malfunctioning areas in case of material failure or any other general malfunctions. Channels in the supply circuit may provide selective shut down areas that would prevent the total system to be affected in case of a malfunction.

The above description is given by way of example only and various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

What is claimed is:

1. A thruster device, comprising:

a force-generating element mounted to a housing, the force-generating element configured to generate a thrust force for propelling the housing, the force-generating element comprising:

a first electrode connected to a first input terminal of a power source, the first electrode including a first longitudinal axis, a second electrode spaced apart by a predetermined distance from the first electrode and connected to a second input terminal of the power source, the second electrode including a second longitudinal axis oriented parallelly to the first longitudinal axis, and a dielectric medium disposed between the first electrode and the second electrode, wherein, upon receiving a field emission condition from the power source, charged particles available at the first electrode accelerate towards the second electrode for generating a thrust force along a direction of movement of the charged particles for propelling the housing, the thrust force generated when the predetermined distance between the first electrode and the second electrode is shorter than a Rindler horizon defined by the charged particles during acceleration.

2. The thruster device as claimed in claim 1, wherein the charged particles are particles generated by the first electrode upon supply of the field emission conditions by the power source.

3. The thruster device as claimed in claim 1, further comprising a charged particle generator mounted to the housing for supplying the charged particles to the first electrode.

4. The thruster device as claimed in claim 3, wherein the charged particle generator is an electron gun.

5. The thruster device as claimed in claim 1, further comprising a positioning mechanism coupled to the first electrode and the second electrode for adjusting the predetermined distance therebetween, the adjustment of the predetermined distance alters a force gradient between the first electrode and the second electrode, resulting in variation of the thrust force.

6. The thruster device as claimed in claim 5, wherein the positioning mechanism is a stepper motor mechanism, coupled to the first electrode and the second electrode, for adjusting the predetermined distance therebetween.

7. The thruster device as claimed in claim 1, further comprising at least one floating electrode positioned between the first electrode and the second electrode, each floating electrode of the at least one floating electrode including a longitudinal axis oriented parallelly to the first electrode and the second electrode, wherein each floating electrode of the at least one floating electrode is configured to accelerate the charged particles for boosting the thrust force.

8. The thruster device as claimed in claim 1, further comprising at least one mesh conductor positioned between the first electrode and the second electrode, each mesh conductor of the at least one mesh conductor including a longitudinal axis oriented parallelly to the first electrode and the second electrode, wherein each mesh conductor of the at least one mesh conductor is configured to accelerate the charged particles for boosting the thrust force.

9. The thruster device as claimed in claim 1, wherein the first electrode is a cathode electrode and the second electrode is an anode electrode.

10. The thruster device as claimed in claim 9, wherein dimensions of the second electrode is configured to be larger than the first electrode for radiation shielding.

11. A thruster device, comprising:

a plurality of force-generating elements mounted to a housing, the plurality of force-generating elements configured to generate a thrust force for propelling the housing, each force generating element of the plurality of force-generating elements comprising:

a first electrode connected to a common first input terminal of a common power source and including a first longitudinal axis, a second electrode spaced apart by a predetermined distance from the first electrode and connected to a common second input terminal of the common power source, the second electrode including a second longitudinal axis oriented parallelly to the first longitudinal axis, and a dielectric medium disposed between the first electrode and the second electrode, wherein, upon receiving a breakdown voltage or a field emission condition from the common power source, charged particles available at the first electrode accelerate towards the second electrode for generating a thrust force along a direction of movement of the charged particles for propelling the housing, the thrust force generated when the predetermined distance between the first electrode and the second electrode is shorter than a Rindler horizon defined by the charged particles during acceleration.

12. The thruster device as claimed in claim 11, wherein the plurality of force-generating elements mounted to the housing, conform to a grid structure.

13. The thruster device as claimed in claim 11, wherein one or more force-generating elements of the plurality of force-generating elements are mounted along a periphery of the housing for manoeuvrability during propulsion.

14. The thruster device as claimed in claim 11, wherein each force generating element of the plurality of force-generating elements is electrically coupled in series with the common power source for generating the thrust force.

15. The thruster device as claimed in claim 14, wherein each force generating element of the plurality of force-generating elements is electrically coupled in series with the common power source via at least one switching device, wherein each switching device of the at least one switching device is communicably coupled to a control unit, the control unit configured to selectively operate each switching device of the at least one switching device for selectively operating each force-generating element of the plurality of force-generating elements to propel the housing.

16. The thruster device as claimed in claim 11, wherein the charged particles are particles generated by the first electrode upon supply of the field emission condition.

17. The thruster device as claimed in claim 11, further comprising a charged particle generator mounted to the housing for supplying the charged particles to the first electrode.

18. The thruster device as claimed in claim 11, further comprising a positioning mechanism coupled to the first electrode and the second electrode of each force generating element of the plurality of force-generating elements for adjusting the predetermined distance therebetween to vary the thrust force, wherein adjustment of the predetermined distance alters a force gradient between the first electrode and the second electrode, resulting in variation of the thrust force from each force generating element of the plurality of force-generating elements.

19. The thruster device as claimed in claim 11, further comprising at least one floating electrode positioned between the first electrode and the second electrode of each force generating element of the plurality of force-generating elements, each floating electrode of the at least one floating electrode including a longitudinal axis oriented parallelly to the first electrode and the second electrode, wherein each floating electrode of the at least one floating electrode is configured to accelerate the charged particles based on quantized inertia, for boosting the thrust force from each force-generating element of the plurality of force-generating elements.

20. The thruster device as claimed in claim 11, further comprising at least one mesh conductor positioned between the first electrode and the second electrode of each force generating element of the plurality of force-generating elements, each mesh conductor of the at least one mesh conductor including a longitudinal axis oriented parallelly to the first electrode and the second electrode, wherein each mesh conductor of the at least one mesh conductor is configured to accelerate the charged particles based on quantized inertia, for boosting the thrust force from each force-generating element of the plurality of force-generating elements.

* * * * *